US005200565A

United States Patent [19]

Satoshi et al.

[11] Patent Number: 5,200,565

[45] Date of Patent: Apr. 6, 1993

[54] MUSICAL TONE SYNTHESIZING APPARATUS HAVING IMPROVED PROCESSING OPERATION

[75] Inventors: Miyata Satoshi; Okamoto Eisaku; Abe Yasunao, all of Hamamatsu, Japan

[73] Assignee: Yamaha Corporation, Hamamatsu, Japan

[21] Appl. No.: 636,067

[22] Filed: Dec. 28, 1990

[30] Foreign Application Priority Data

Jan. 5, 1990 [JP] Japan ..... 2-70

[51] Int. Cl.[5] ..... G10H 1/08

[52] U.S. Cl. ..... 84/602; 84/604; 84/647

[58] Field of Search ..... 84/604-606, 84/653, 647, 601-603

[56] References Cited

U.S. PATENT DOCUMENTS 4,622,877 11/1986 Strong ..... 84/604

4,947,723 8/1990 Kawashima et al. ..... 84/603

FOREIGN PATENT DOCUMENTS 60-42954 9/1985 Japan .

*Primary Examiner*—William M. Shoop, Jr.

*Assistant Examiner*—Brian Sircus

*Attorney, Agent, or Firm*—Graham & James

[57] ABSTRACT

A musical tone synthesizing apparatus, which has a musical tone memory, generates a musical tone by accessing the musical tone memory. In ordinary state, the tone generator directly accesses the memory and generates musical tones based upon the accessed data. On the contrary, when a microprocessor directly accesses, first, an initial address to be access in the memory is set. Then, musical tone data are consecutively read out from or written in the memory by automatic increment of the address which is started from the initial set address. As a result, it is not necessary for the microprocessor to designate every address of the musical tone data to be read out or written. So, the microprocessor is not overloaded.

4 Claims, 6 Drawing Sheets

MUSICAL TONE SYNTHESIZING APPARATUS HAVING IMPROVED PROCESSING OPERATION

BACKGROUND OF THE INVENTION

1. Field of the Invention

The present invention relates to a musical tone synthesizing apparatus used in, e.g., an electronic musical instrument.

2. Description of the Prior Art

In a conventional sound source system used in an electronic musical instrument, various musical tone synthesizing apparatuses or circuits controlled by, e.g., a microcomputer (to be referred to as a CPU hereinafter) are used. Typical systems can be roughly classified into:

(1) a system wherein all the musical tone control parameters are supplied from a CPU, in other words, a system wherein various musical tone parameters are mainly controlled by the CPU; and (2) a system wherein a CPU supplies only real-time performance instructions such as designation of pitches of musical tones, generation start and end timings of musical tones, and the like, parameters for determining characteristics of musical tones are stored in a parameter memory connected to a musical tone signal generator (sound source), and read-out control of these parameters is performed by the sound source.

According to the system (1), musical tones are easy to control while performing various arithmetic processing operations of musical tone parameters by the CPU and software, and a musical tone generation system which can be used in various modes can be constituted. According to the system (2), a system depending on a performance of a CPU to be used can be constituted, and manufacturing cost can be reduced.

However, when the system (1) is employed, this system can be used in various modes, but poses problems that about synchronization between a sound source and the CPU, i.e., synchronization devices are necessary. As a result, manufacturing cost tends to be increased considerably. On the other hand, the system (2) has a problem that various musical tone parameters cannot be set in the system.

SUMMARY OF THE INVENTION

The present invention has as its object to provide a musical tone synthesizing apparatus which does not overload a CPU, and can be used in various modes.

According to the present invention, the musical tone synthesizing apparatus comprises memory means for storing parameters for determining characteristics of musical tones, information processing means for outputting musical tone control data and control signal, the information processing means being capable of accessing to the memory means, designating means for designating the memory means to connect to the information processing means based on the control signal, address setting means for setting an address value of the memory means responsive to the control signal, the address value being used as an initial address when the memory means is connected to the information processing means, increment means for incrementing the address value by a predetermined number in response to access of the information processing means to the memory means, and tone generating means, capable of being connected to the memory means, for generating a musical tone signal.

It is preferable that the address setting means independently sets read and write addresses, and the increment means independently increments the read and write address values set by the address setting means.

With this arrangement, an information processing means such as a microcomputer (to be simply referred to as a CPU hereinafter) generates a musical tone parameter such as a pitch or rhythm parameter in real time on the basis of an event generated upon an operation of, e.g, a keyboard, and outputs them to a musical tone generation means. The musical tone generation means generates and outputs a musical tone signal on the basis of the output from the CPU and data read out from a memory means. In this case, since access of the memory means can be switched to the CPU side, the CPU can access the memory means as needed to load data for determining characteristics of musical tones, and can appropriately process the loaded data. Then, the CPU can write the processed data in the memory means again or output it to the musical tone generation means, thus allowing generation of a musical tone signal in various modes.

When a waveform or musical tone parameter stored in the memory means is to be accessed, adjacent data, i.e., data at successive addresses are often read out sequentially. When such data are to be processed, a start address is set by the address setting means, and thereafter, read/write access is performed while incrementing the set address value by a predetermined number of times under an instruction from the CPU. Thus, read/write access of data at successive addresses can be performed without requiring cumbersome operations, i.e., updating address data having a large bit length for each access. Therefore, the CPU is not overloaded, and can access the memory means without adversely prolonging a processing time.

Since read and write addresses upon access from the CPU can be independently set and incremented, access of data such as musical tone waveform data which tend to be successively subjected to read/write access can be performed quickly.

DETAILED DESCRIPTION OF THE PREFERRED EMBODIMENT

An embodiment of the present invention will be described hereinafter with reference to the accompanying drawings.

Figure 1A:
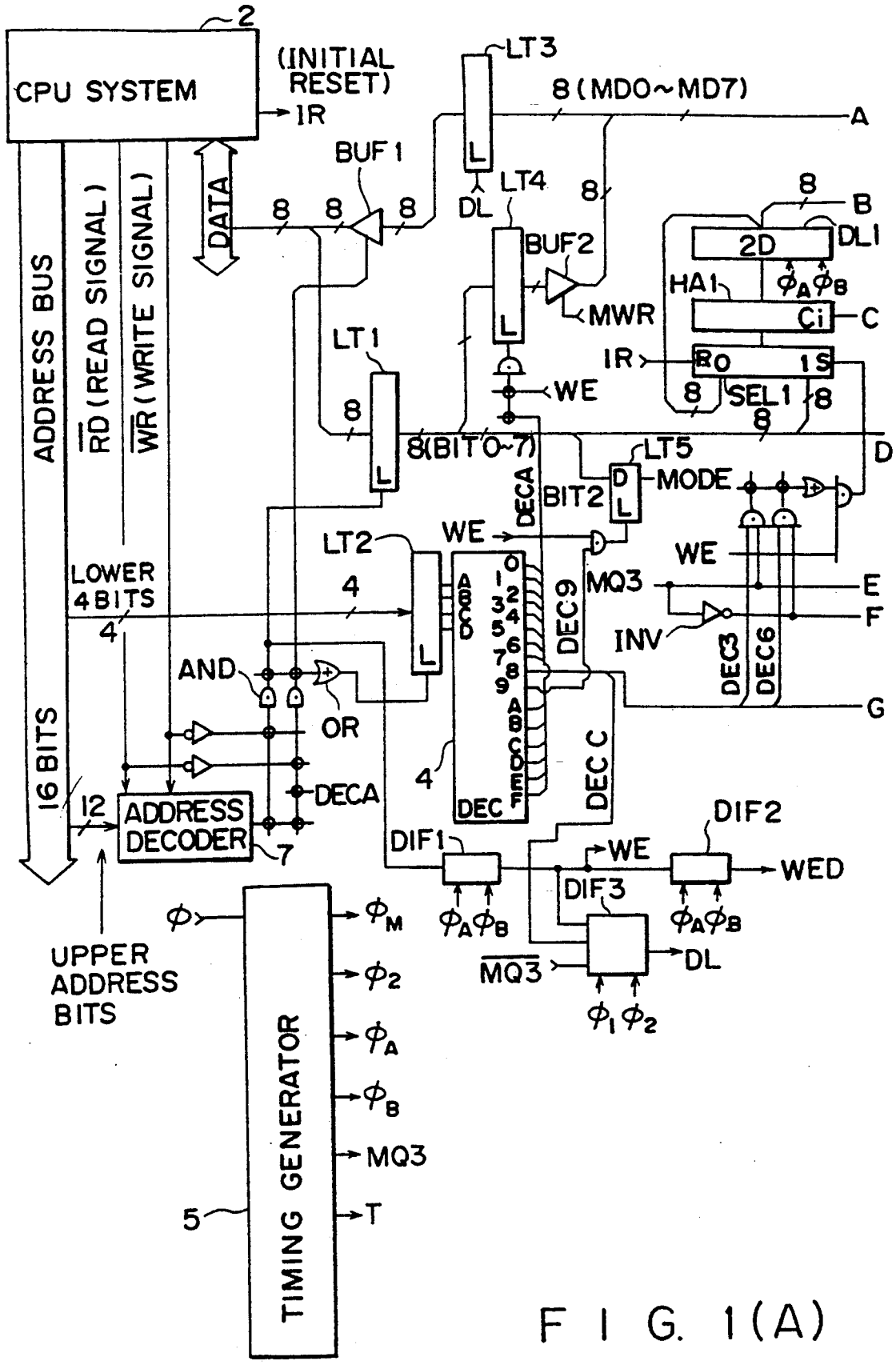
FIGS. 1(A) and 1(B) illustrate a circuit diagram of a musical tone synthesizing apparatus according to an embodiment of the present invention.
Figure 1B:
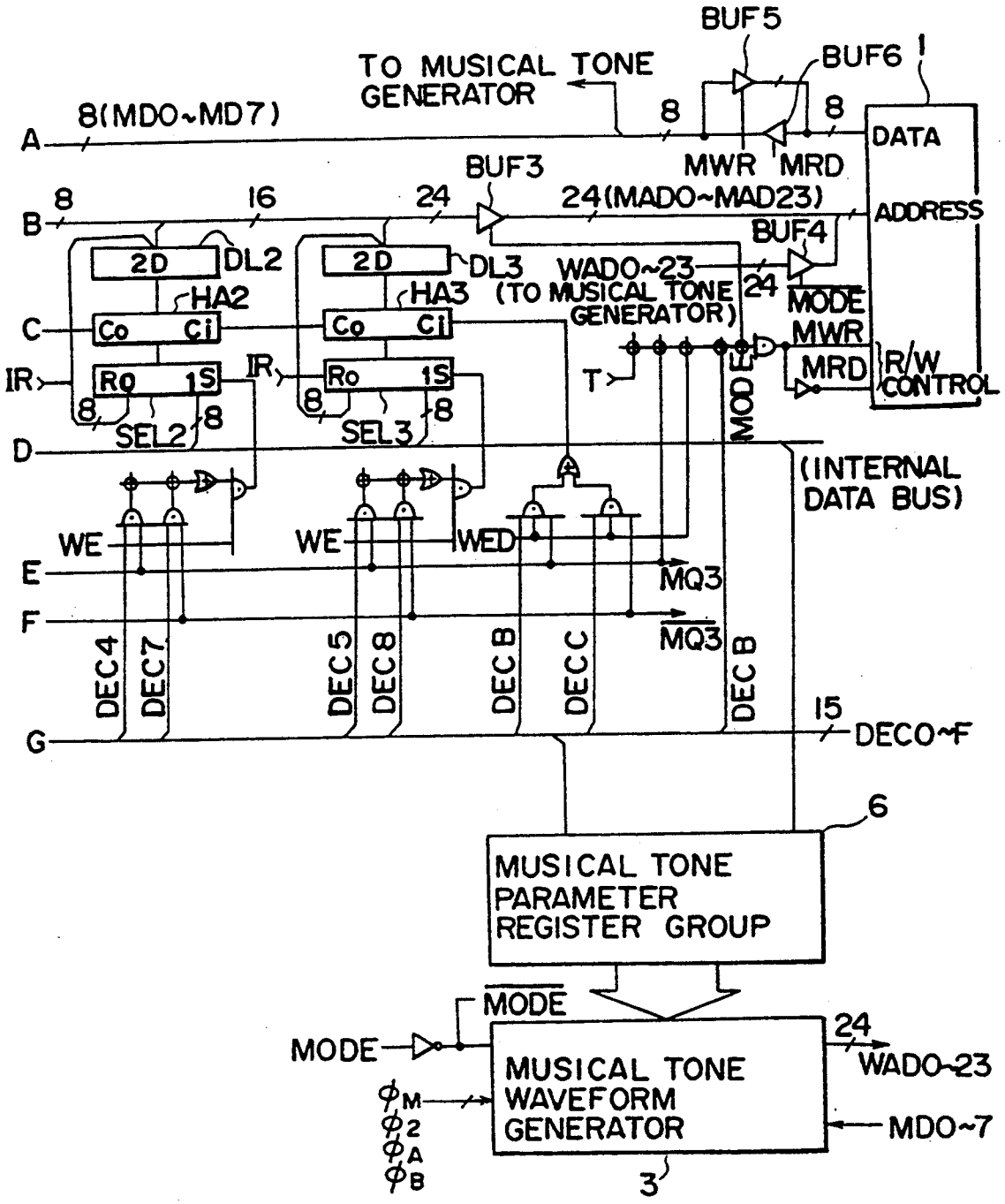

FIG. 1 is a circuit diagram of a musical tone synthesizing apparatus according to an embodiment of the present invention.

In FIG. 1, reference numeral 1 denotes a musical tone memory for storing waveforms and musical tone parameters for mainly determining characteristics of musical tones; 2, a CPU for mainly outputting real-time musical tone data including pitches and generation start and end timings of musical tones; and 3, a musical tone waveform generator for generating a musical tone signal on the basis of outputs from the musical tone memory 1 and the CPU 2.

In this embodiment, data in the musical tone memory 1 has an 8-bit configuration, and its address has a 24-bit configuration. A data bus of the CPU 2 has an 8-bit configuration, and its address bus has a 16-bit configuration.

Reference symbol LT1 denotes a latch for temporarily storing data written by the CPU 2; LT2, a latch for temporarily storing lower four bits of an address to be accessed by the CPU 2; LT3, a latch for temporarily storing data read out from the musical tone memory 1 in response to an instruction from the CPU 2; LT4, a latch for fetching data written by the CPU 2 in the musical tone memory 1 from the latch LT1; and LT5, a latch for fetching a bit from the latch LT1 to designate a mode in which the CPU 2 accesses the musical tone memory 1. An output signal MODE from the latch LT5 indicates an access instruction from the CPU 2 to the musical tone memory 1 when it is at logic "1". During this interval, the musical tone waveform generator 3 halts access of the musical tone memory 1.

Figure 2:
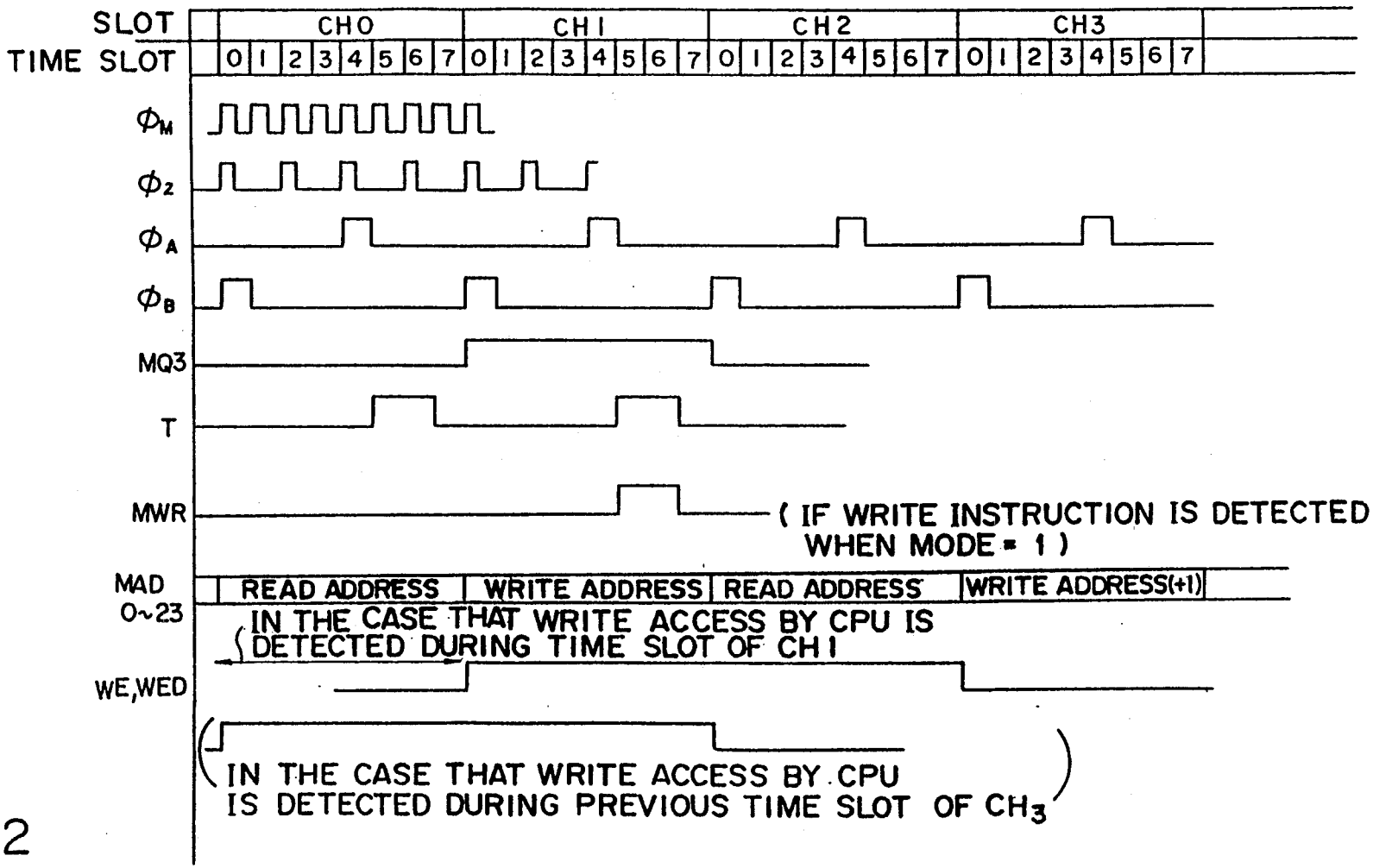
FIG. 2 is a timing chart showing timings of signals when a CPU issues a write instruction in a CPU access mode in the apparatus shown in FIG. 1.
Figure 3:
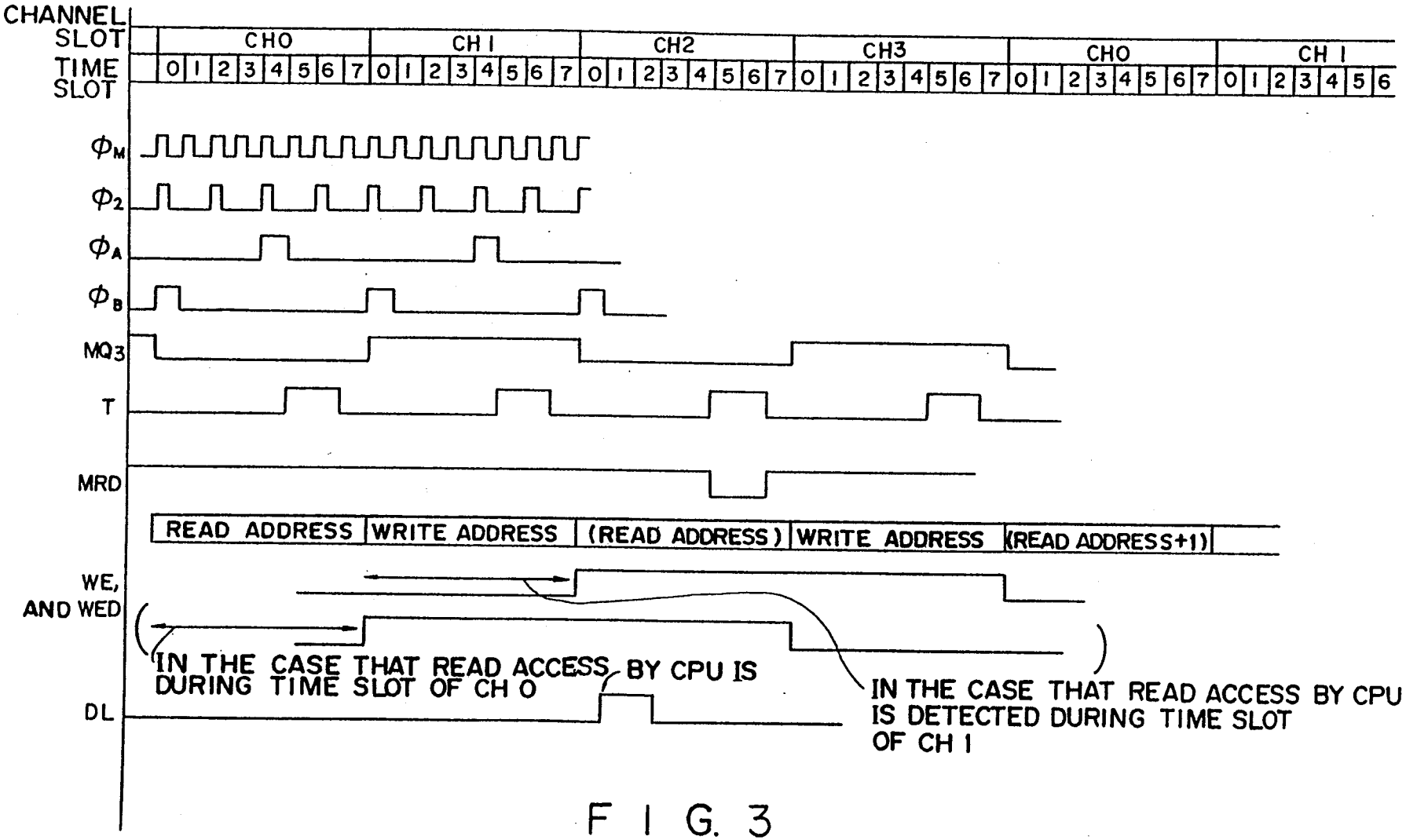
FIG. 3 is a timing chart showing timings of signals when the CPU issues a read instruction in the CPU access mode in the apparatus shown in FIG. 1.

Reference symbols DL1 to DL3 denote latches in which upper, middle, and lower 8 bits of an address are respectively set when the CPU 2 accesses the musical tone memory 1. Each of the latches DL1 to DL3 has a two-stage data latch arrangement, and can independently set and store read and write addresses. As shown in the timing chart of FIG. 2 or 3, each latch fetches data in response to a timing signal $\phi_A$, and outputs data (MAD0 to MAD23) in response a timing signal $\phi_B$. As shown in FIG. 2 or 3, the apparatus of this embodiment processes four channels by a time-divisional multiplex method. That is, a read address is stored and set in an even-numbered channel slot, and a write address is stored and set in an odd-numbered channel slot.

Reference symbols HA1 to HA3 denote half adders; and SEL1 to SEL3, selectors for fetching address data from the CPU 2 via the latch LT1, or fetching address data set in the latches DL1 to DL3 to increment them.

The latches DL1 to DL3 receive address data from the CPU 2, which is fetched by the selectors SEL1 to SEL3, via the half adders HA1 to HA3 at predetermined timings. The address data is incremented at predetermined timings via the selectors SEL1 to SEL3 and the half adders HA1 to HA3 on the basis of the instruction from the CPU2.

Reference numeral 4 denotes a decoder for decoding lower 4-bit access address data from the CPU 2 and latched by the latch LT2, and generating command signals DEC0 to DECF. An address decoder 7 has a function of decoding upper 12 bits address data from the CPU 2. In this embodiment, when upper 12 bits are $F00, a decoded output becomes logic "1". More specifically, the decoder 4 decodes $F00X, and hence, the circuit occupies address $F000 to address $F00F of an address space of the CPU 2 ("$" represents hexadecimal notation; a hexadecimal value will be expressed by adding "$" as a prefix hereinafter).

Reference numeral 5 denotes a timing generator for outputting various necessary clocks on the basis of a fundamental system clock $\phi$ (basically, a double-speed clock of an internal fundamental clock $\phi_M$). As described above, the apparatus of this embodiment has a four-tone generation channel configuration for processing four channels by the time-divisional multiplex method. Each channel slot is constituted by eight time slots TS0 to TS8. The timing generator 5 generates the internal fundamental clock $\phi_M$, a clock $\phi_A$ which goes to logic "1" in a time slot TS4 (data fetch instruction for the latches DL1 to DL3), a clock $\phi_B$ which goes to logic "1" in a time slot TS0 (data output instruction for the latches DL1 to DL3), a timing signal MQ3 which goes to logic "1" in an odd-numbered channel slot, and a signal T which goes to logic "1" during a period between time slots TS5 and TS6, as shown in FIG. 2 or 3.

Reference symbol DIF1 denotes a timing generation circuit for generating a timing pulse WE for transferring data latched by the latch LT1 to internal latches such as the latches LT4 and LT5 in accordance with access by the CPU 2; and DIF2, a timing generation circuit for generating a pulse signal WED for instructing a write timing of data stored in the latch LT4 in the musical tone memory 1 after the pulse WE is generated, or instructing to increment address data set in the latches DL1 to DL3. The signals WE and WED go to logic "1" in the next odd- and even-numbered channel slots, respectively, when the CPU 2 performs access in a given even-numbered channel slot. Meanwhile, when the CPU 2 performs access in a given odd-numbered channel slot, the signals WE and WED go to logic "1" in the next even- and odd-numbered channel slots, respectively. Reference symbol DIF3 denotes a timing generation circuit for generating a timing signal DL for causing the latch LT3 to latch data read out from the musical ont memory 1 in accordance with a request (output DECC from the decoder 4) supplied from the CPU 2 and indicating that data is read out from the musical tone memory 1.

In addition, signals generated in the apparatus include a write signal MWR to the musical tone memory 1, a read signal MRD (inverted signal of the signal MWR) to the musical tone memory 1, address signals WAD0 to WAD23 from the musical tone waveform generator 3 to the musical tone memory 1, data signals MD0 to MD7 from the musical tone memory 1 to the musical tone waveform generator 3 or the CPU 2, and access address signals MAD0 to MAD23 from the CPU 2 to the musical tone memory 1. The timing charts of the above-mentioned signals are as shown in FIGS. 2 and 3.

Reference numeral 6 denotes a group of registers for storing musical tone parameters outputted from the CPU 2 via the latch LT1. The musical tone waveform generator 3 obtains real-time musical tone data from the CPU 2 via the register group 6.

Reference symbols BUF1 to BUF6 denote gate circuits; AND, an AND gate; OR, an OR gate; and INV, an inverter.

Figure 4:
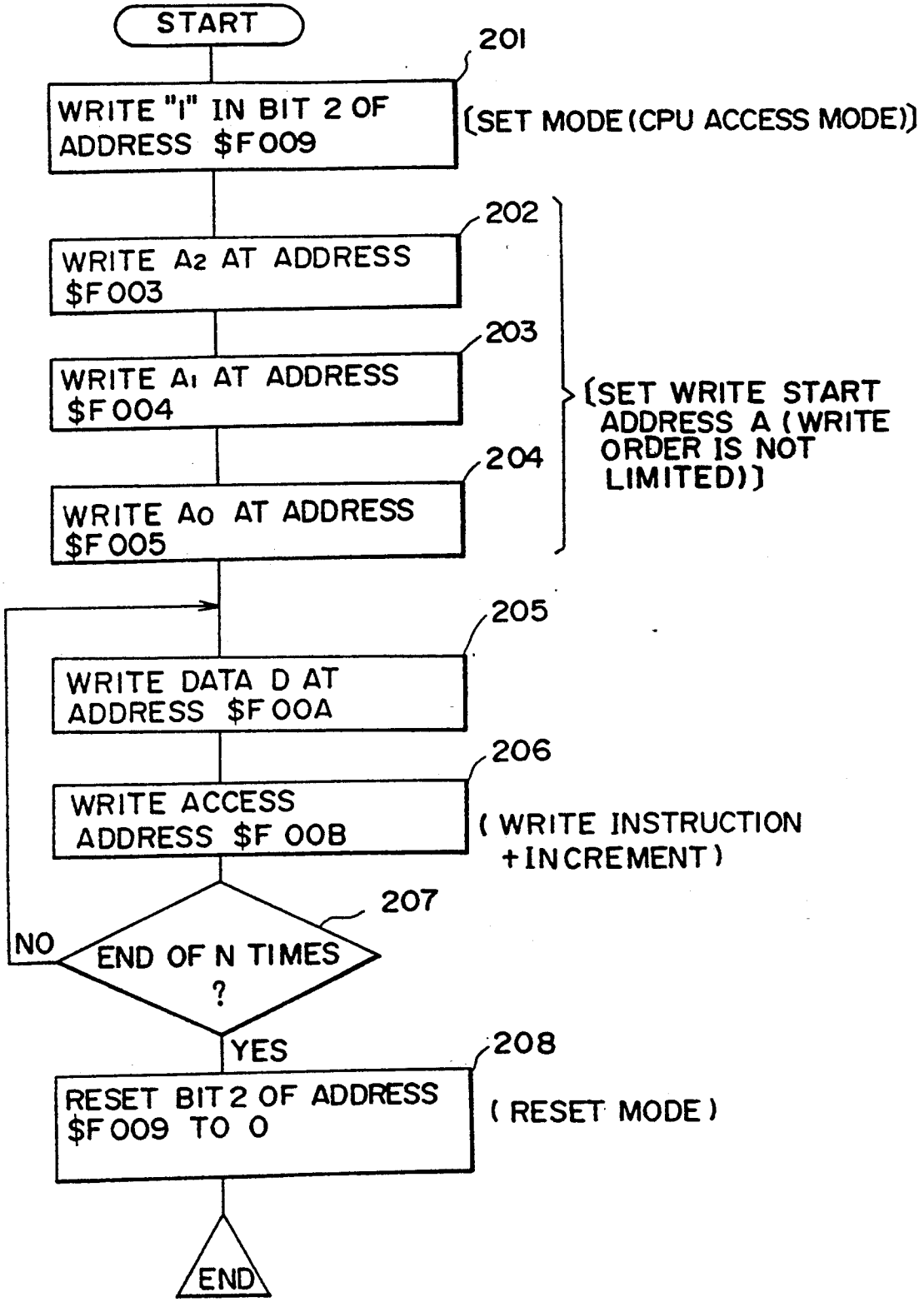
FIG. 4 is a flow chart showing a data write operation from the CPU to a musical tone memory in the apparatus shown in FIG. 1.
Figure 5:
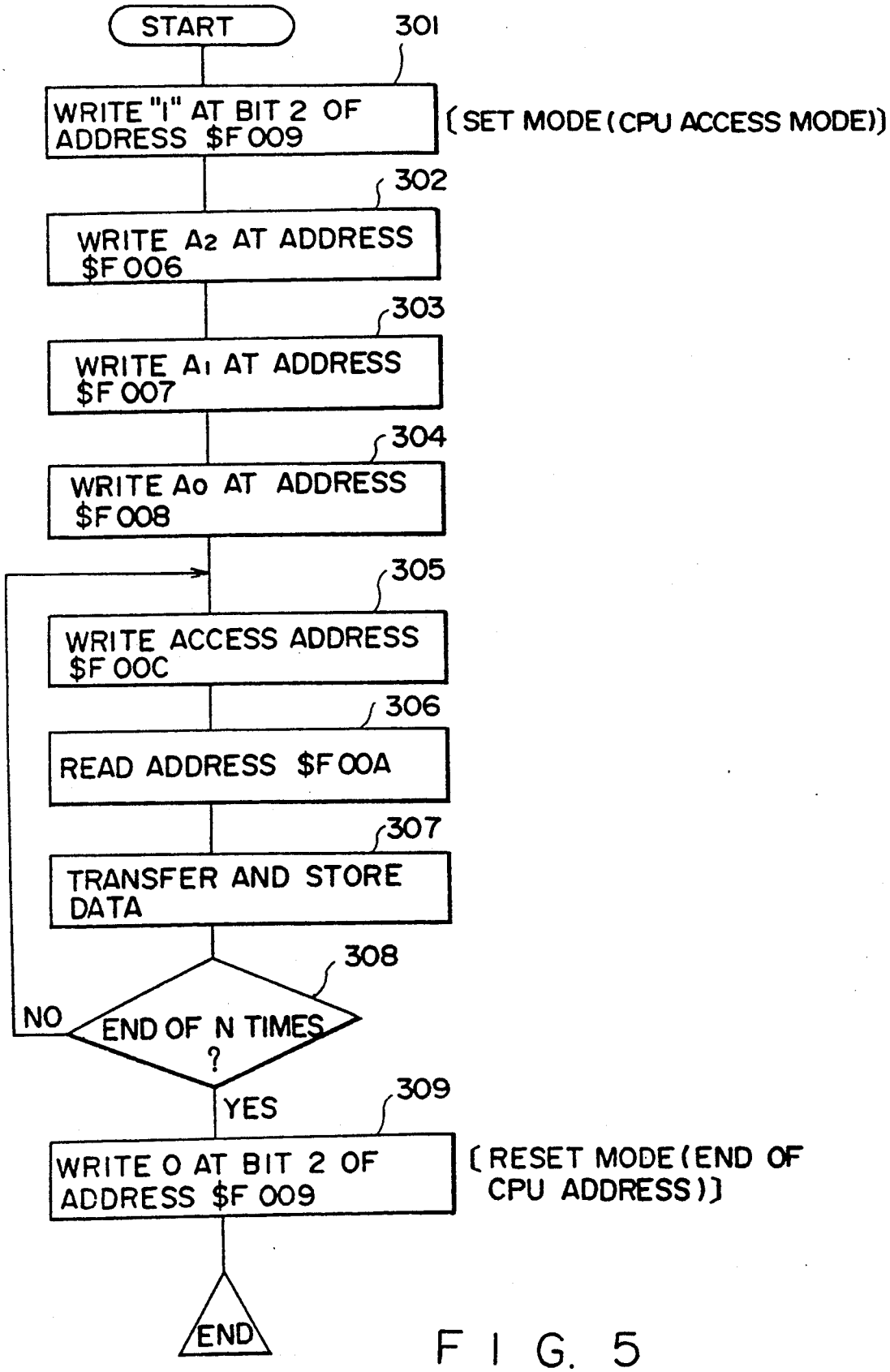
FIG. 5 is a flow chart showing a data read operation from the musical tone memory to the CPU in the apparatus shown in FIG. 1.

FIG. 4 is a flow chart showing an operation for writing data from the CPU 2 in the musical tone memory 1, and FIG. 5 is a flow chart showing an operation for reading out data from the musical tone memory 1 to the CPU 2.

A case will be described below with reference to FIGS. 2 and 4 wherein predetermined N-byte data D is written from the CPU 2 to the musical tone memory 1 from an address A ($A_2$, $A_1$, and $A_0$ from upper bits, i.e., 8 bits×3 digits).

In step 201, the CPU 2 writes data $04 at address $F009. The data $04 is latched from the CPU 2 by the latch LT1 in accordance with a write signal from the CPU 2. The latch LT2 latches lower four bits of address data. The latched data are decoded by the decoder 4. As a result, a signal DEC9 goes to logic "1". The timing generation circuit DIF1 sets the signal WE at logic "1" at a timing of the signal $\phi_B$ in accordance with a write signal WR from the CPU 2. Thus, the latch LT5 latches the second bit of the latch LT1, and its output MODE goes to logic "1". Thus, an access mode from the CPU 2 to the musical tone memory 1 is set, and the gate BUF3 is enabled. On the other hand, the gate BUF4 is disabled, and address outputs WAD0 to WAD23 of the musical tone waveform generator 3 are disconnected from the musical tone memory 1.

In steps 202 to 204, a write address A (start address) for the musical tone memory 1 is set.

In step 202, the CPU 2 writes upper 8-bit data of the address A at address $F003. Thus, the latch LT1 latches data $A_2$, the latch LT2 latches $3, and an output DEC3 from the decoder 4 goes to logic "1". The data $A_2$ is transferred from the latch LT1 to the selector SEL1 at a timing that the signals MQ3 and WE are at "1" level, and is then latched by the latch DL1 via the half adder HA1 at a timing of the signal $\phi_A$.

Thereafter, in steps 203 and 204, data $A_1$ is written at address $F004, and data $A_0$ is written at address $F005, so that data $A_1$ and $A_0$ are similarly fetched by the latches DL2 and DL3, thereby setting the address A. The data $A_2$ to $A_0$ need not always be latched in this order.

In step 205, the CPU 2 writes first one byte of data D at address $F004. This data is first latched by the latch LT1, and is then latched by the latch LT4 at a timing that the signal WE is at "1" level.

In step 206, the CPU 2 write-accesses address $F00B. At this time, data to be written can be any data, and dummy data is written. Thus, an output DECB from the decoder 4 goes to logic "1", and the signal WED also goes to logic "1" at a timing of the signal $\phi_B$. Therefore, the write signal MWR goes to logic "1" at a timing of the signal T in an odd-numbered channel slot where the signal MQ3 is at logic "1". As a result, the gates BUF2 and BUF5 are enabled, and data in the latch LT4 is written at the address A on the musical tone memory 1. Since a carry-in signal Ci of the half adder HA3 goes to logic "1" in response to the leading edge of the signal WED, the address A set in the latches DL1 to DL3 is outputted to the selector SEL1 to SEL3 at the timing $\phi_B$ in the next odd-numbered channel slot. When the address A is latched by the latches DL1 to DL3 at the timing $\phi_A$ again, it is incremented by "1".

It is then checked in step 207 if all the N-byte data D is written. If NO in step 207, the flow returns to step 205, and the next one-byte data of the data D is similarly stored in the latch LT4, and is similarly written in the musical tone memory 1 in step 206. At this time, since the address value stored in the latches DL1 to DL3 corresponds to a sum of the immediately preceding write address value and "1", write access is performed at an address A+1 if the immediately preceding write address is the address A.

In this manner, if it is determined that write access is performed N times, and all the N-byte data is written, the flow advances to step 208, and the CPU 2 writes $00 at address $F009. Thus, "0" is latched by the latch LT5, and the mode signal MODE is reset to logic "0", thereby setting an access mode by the musical tone waveform generator 3.

An operation for reading out N-byte data from an address A of the musical tone memory 1 to the CPU 2 side will be described below with reference to FIGS. 3 and 5.

In step 301, the CPU 2 write $04 at address $F009 in the same manner as described above, thus setting the access mode from the CPU 2.

In steps 302 to 304, a read address A for the musical tone memory 1 is set. In this case, 8-bit data $A_2$, $A_1$, and $A_0$ constituting the address A are written at addresses $F006, $F007, and $F008, respectively, and are latched by the latches DL1 to DL3 at a timing of an inverted signal of the signal MQ3.

In step 305, the CPU 2 write-accesses address $F00C. Thus, the signal WE goes to logic "1" at a timing of the signal $\phi_B$, and the timing generation circuit DIF3 outputs the timing signal DL in the next even-numbered channel slot, i.e., when the signal MQ3 is at logic "0". At this time, since the read signal MRD is at logic "1", and hence, the gate BUF6 is enabled, the content of the address A of the musical tone memory 1 is latched by the latch LT3. Meanwhile, when the signal WED goes to logic "1" and the signal MQ3 goes to logic "0", a carry-in signal Ci of the half adder HA3 goes to logic "1". Therefore, address data in the latches DL1 to DL3 are incremented by one in the next even-numbered channel slot in the same manner as described above.

In step 306, the CPU 2 reads address $F00A. Thus, the gate BUF1 is enabled, and the content of the latch LT3 is read out to and stored in the CPU 2.

In step 308, it is checked if read access from the musical tone memory 1 is performed N times. If NO in step 308, the flow returns to step 305, and read access of the next address of the musical tone memory 1 is performed.

In this manner, if it is that read access is performed N times, and all the N-byte data is read out, the mode signal is reset in step 309 in the same manner as described above. Thus, the access mode by the musical tone waveform generator 3 is set again.

In the above description, a plurality of channels are processed by the time-divisional multiplex method. However, the present invention can be carried out regardless of the time-divisional processing and the number of processing channels. In addition, the present invention can be carried out regardless of the number of bits of data, and the scale of the address space.

Methods of taking and giving timings in respective sections are not limited to those in the above embodiment. For example, an increment operation of an address of the musical tone memory can be performed independently of a data write instruction. In the above description, when the CPU write-accesses a given address ($F00C), data read out from the musical tone memory is transferred, and an address of the musical tone memory is incremented. However, these operations may be performed upon read access by the CPU. Furthermore, in the above description, data read out from the musical tone memory and latched by the latch LT3 is read out when the CPU accesses address $F00A.

At the same time, an address value of the musical tone memory may be incremented.

In this embodiment, an address signal path to the musical tone memory 1 is directly disconnected based on the signal mode. However, the address signal path may be switched after a tone generation state or the like of the musical tone waveform generator is formed. For example, the address signal path may be switched after all tone generations are completed by, e.g., forcible damp processing.

As described above, according to the present invention, since an access mode switching means is arranged, a musical tone waveform generation means accesses a musical tone memory in a standard operation mode, and a CPU can desirably access the musical tone memory as needed. Thus, musical tone synthesizing operations in various modes can be performed with an inexpensive arrangement which does not overload the CPU.

Since each address data latch in an address setting means has a two-stage configuration, read and write addresses can be independently set, and are independently incremented. Therefore, data such as musical tone waveform data, which is often successively subjected to read/write access, can be accessed quickly.

Therefore, there can be obtained a musical tone synthesizing apparatus, which has a relatively simple arrangement, can edit musical tone parameters or perform arithmetic processing of waveforms, and has a high degree of freedom.

What is claimed is:

1. A musical tone synthesizing apparatus comprising:

memory means for storing musical tone control parameters for determining characteristics of musical tones;

information processing means, capable of being operatively connected to said memory means, for outputting musical tone control data and a control signal;

control means for causing said memory means to connect to said information processing means based on said control signal;

address setting means for setting an address value for sending to said memory means responsive to said control signal, said address value being used as an initial address when said memory means is connected to said information processing means;

increment means for incrementing the address value by a predetermined number in response to connection of said information processing means to said memory means; and tone generating means, capable of being connected to said memory means, for controlling the reading out of musical tone parameters from the memory means and for generating a musical tone signal based on said read out musical tone control parameters.

2. An apparatus according to claim 1, wherein said address setting means independently sets read and write addresses, and said increment means independently increments read and write address values set by said address setting means.

3. A musical tone synthesizing apparatus comprising:

memory means for storing parameters for determining characteristics of musical tones;

information processing means, capable of being operatively connected to said memory means, for outputting musical control data and a control signal;

control means for causing said memory means to connect to said information processing means based on said control signal;

address setting means for setting an address value for sending to said memory means responsive to said control signal, said address value being used as an initial address when said memory means is connected to said information processing means;

increment means for incrementing the address value by a predetermined number in response to connection of said information processing means to said memory means;

reading means for reading out the musical tone parameters from said memory means in accordance with said address setting means and increment means;

writing means for writing musical tone control parameters into said memory means in accordance with said address setting means and increment means;

control means for controlling timings of operation of said reading means and writing means in a time divisional manner; and tone generating means for controlling the reading out of musical tone control parameters from said memory means and for generating a musical tone signal based on the read out parameters.

4. A musical tone synthesizing apparatus comprising:

memory means for storing musical tone control parameters for determining characteristics of musical tone;

tone generating means, capable of being connected to said memory means, for controlling the reading out of musical control tone parameters from the memory means and for generating a musical tone signal based on the read out parameters;

information processing means, capable of being connected to said memory means, for outputting musical tone control data and a control signal;

control means for turning off a connection of said tone generating means to said memory means based on said control signal;

address setting means for setting an address value for sending to said memory means responsive to said control signal, said address value being used as an initial address when said memory means is connected to said information processing means;

increment means for incrementing the address value by a predetermined number in response to connection of said information processing means to said memory means; and writing means for writing a waveform data into said memory means in accordance with said increment means while the connection of the memory means to said tone generating means is turned off.

* * * * *